US012209344B2

(12) United States Patent
O et al.

(10) Patent No.: US 12,209,344 B2
(45) Date of Patent: Jan. 28, 2025

(54) BACTERICIDAL AND VIRUCIDAL FABRIC

(71) Applicant: Nano and Advanced Materials Institute Limited, Hong Kong (HK)

(72) Inventors: Wing Nien Wylie O, Hong Kong (HK); Tsz Hin Yui, Hong Kong (HK)

(73) Assignee: Nano and Advanced Materials Institute Limited, Hong Kong (HK)

( * ) Notice: Subject to any disclaimer, the term of this patent is extended or adjusted under 35 U.S.C. 154(b) by 901 days.

(21) Appl. No.: 17/230,994

(22) Filed: Apr. 14, 2021

(65) Prior Publication Data

US 2022/0064836 A1 Mar. 3, 2022

Related U.S. Application Data

(60) Provisional application No. 63/072,238, filed on Aug. 31, 2020.

(51) Int. Cl.
*D06B 3/18* (2006.01)
*D06B 21/00* (2006.01)

(52) U.S. Cl.
CPC ..... *D06B 3/18* (2013.01); *D06B 21/00* (2013.01); *D10B 2401/13* (2013.01)

(58) Field of Classification Search
CPC ..... D06B 3/18; D06B 21/00; D10B 2401/13
See application file for complete search history.

(56) References Cited

U.S. PATENT DOCUMENTS

| | | | |
|---|---|---|---|
| 6,861,520 | B1 | 3/2005 | Todd |
| 8,129,450 | B2 | 3/2012 | Wood et al. |
| 2012/0060258 | A1 | 3/2012 | Stewart et al. |

FOREIGN PATENT DOCUMENTS

| | | | | | |
|---|---|---|---|---|---|
| CN | 1157574 | A | | 8/1997 | |
| CN | 1432085 | A | | 7/2003 | |
| CN | 102517774 | A | | 6/2012 | |
| CN | 110904679 | | * | 3/2020 | ..... D06M 15/03 |
| CN | 110904679 | A | | 3/2020 | |
| CN | 111138828 | A | | 5/2020 | |
| JP | 2006045686 | A | | 2/2006 | |
| WO | 0222941 | A1 | | 3/2002 | |
| WO | 2012064894 | A1 | | 5/2012 | |

OTHER PUBLICATIONS

A.M., Eremenko et al. "Antibacterial and Antimycotic Activity of Cotton Fabrics, Impregnated with Silver and Binary Silver/Copper Nanoparticles" Nanoscale Research Letters, vol. 11(1), p. 1-9.

Ozgun, Kocabiyik et al. "Non-Toxic Virucidal Macromolecules Show High Efficacy Against Influenza Virus Ex Vivo and In Vivo" Advanced Science, vol. 8(3), p. 1-9.

Office Action of corresponding China Patent Application No. 202110511258.8 mailed on Mar. 15, 2023.

* cited by examiner

*Primary Examiner* — Amina S Khan
(74) *Attorney, Agent, or Firm* — Idea Intellectual Limited; Margaret A. Burke; Sam T. Yip

(57) ABSTRACT

The present invention provides a bactericidal and virucidal fabric selected from cotton or non-woven fabric prepared by formulations and methods described herein. The formulations include a beta-cyclodextrin-containing compound associated with one or more metal ions including at least zinc ions and water for providing bactericidal and virucidal properties to the fabric dip-coated with the formulations according to various embodiments of the present invention. The as-prepared fabric has an increment in Grams per Square Meter (GSM) value of approximately 13.0 to 20.0 $g/m^2$, an antibacterial activity value of at least 3.0, and/or antiviral activity value of at least 2.5.

8 Claims, No Drawings

BACTERICIDAL AND VIRUCIDAL FABRIC

CROSS-REFERENCE TO RELATED APPLICATIONS

This application claims priority from the U.S. provisional patent application No. 63/072,238 filed Aug. 31, 2020, and the disclosure of which is incorporated herein by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention provides a bactericidal and virucidal fabric. In particular, a bactericidal and virucidal fabric prepared from a formulation including a beta-cyclodextrin-containing compound associated with one or more metal ions including at least zinc ions and water is provided.

BACKGROUND

Impregnating fabric with a germicide (e.g., bactericide and virucide) to gain antimicrobial activity is known in the art, but this kind of fabric is usually not durable or is unstable in terms of its germicidal activity. Even though some prior arts proposed a relatively more stable structure to associate the antibacterial/antiviral agent with the fiber of the fabric to enhance its durability to washing and tumble drying, the structure is usually not safe, or may cause irritation to the skin of the wearer when he/she is in close contact with the fabric, owing to the use and leaching of harmful substances such as heavy metals, including but not limited to nanosilver particles, and/or volatile organic materials, including but not limited to triclosan. This common problem exists in the following prior art.

CN1432085A

CN102517774B

US20120060258A1

As well, production and wastewater treatment costs are important concerns in the textile and disposable product industries. If the impregnation of germicide into the fabric creates large amounts of wastewater and/or involves use of huge amounts of heavy metals or toxic chemicals, treatment thereof before discharge will be costly. Use of a stable, skin-friendly, and non-toxic structure that associates the antibacterial/antiviral agent with the fiber of the fabric is a way to reduce the treatment cost and also protect our environment, especially to aquatic life.

Cyclodextrin seems to be one of the promising antibacterial and antiviral agents to replace the harmful substances that most of the conventional fabric use, because cyclodextrin is able to cause conformational change and/or denature some of the bacterial or viral proteins when the bacteria or viruses are in contact with some of the functional groups of cyclodextrin derivatives.

Therefore, there is a need for a new formulation containing a durable and safe cyclodextrin complex for preparing a bactericidal and virucidal fabric with a simplified procedure with fewer harmful materials involved which are favorable to industrial-scale production.

SUMMARY OF THE INVENTION

Accordingly, one aspect of the present invention provides a dip-coating, antibacterial, and antiviral formulation for preparing a bactericidal and virucidal fabric selected from a non-woven or woven fabric, wherein the formulation includes at least a beta-cyclodextrin-containing compound associated with one or more metal ions including at least zinc ions and water in order to render the dip-coated fabric bactericidal and virucidal to a variety of bacteria and viruses.

In a first embodiment of the present invention, the formulation further includes at least one organic acid.

In a second embodiment of the present invention, the formulation further includes at least one metal salt.

In a third embodiment, said beta-cyclodextrin includes at least one carboxylic ester unit and one carboxylic acid unit.

In a specific embodiment, a first organic acid of the at least one organic acid is ethylenediaminetetraacetic acid and the first organic acid is in a mole ratio of 4:1 to the beta-cyclodextrin-containing compound when said formulation is for preparing the bactericidal and virucidal woven fabric.

In a fourth embodiment of the present invention, the at least one metal salt comprises sodium dihydrogen phosphate, sodium hydrogen carbonate and zinc acetate.

In a fifth embodiment of the present invention, the beta-cyclodextrin-containing compound associated with zinc ions and ethylenediaminetetraacetic acid:citric acid:sodium dihydrogen phosphate are in a weight ratio of 11:50:15 being dissolved in water at approximately 60 degrees Celsius until thoroughly dissolved to form a first solution; sodium hydrogen carbonate is dissolved in water at room temperature or approximately 25 degrees Celsius until thoroughly dissolved to form a second solution; zinc acetate is dissolved in water at room temperature until thoroughly dissolved to form a third solution. Preferably, the fabric is dip-coated with the first, second and third solutions sequentially; the fabric is woven fabric including cotton fabric.

In a sixth embodiment of the present invention, the formulation further includes a vinyl polymer when the formulation is for preparing bactericidal and virucidal non-woven fabric.

In a seventh embodiment of the present invention, the vinyl polymer is polyvinyl alcohol.

In an eighth embodiment of the present invention, the beta-cyclodextrin-containing compound, a second organic acid, the vinyl polymer and one or more of the metal salts are in a weight ratio of 2:2:2:1 dissolved in water at approximately 25 degrees Celsius followed by stirring at approximately 80 degrees Celsius until a thorough mixture is formed.

In a ninth embodiment of the present invention, the beta-cyclodextrin-containing compound is sodium (beta-cyclodextrin)propylsulfonate.

In a tenth embodiment of the present invention, a second organic acid of the at least one organic acid is citric acid monohydrate.

In an eleventh embodiment of the present invention, the at least one metal salt includes zinc acetate dihydrate and copper(II) acetate hydrate In a twelfth embodiment of the present invention, the non-woven fabric includes but not limited to, polypropylene, polyethylene, or any combination thereof.

Another aspect of the present invention provides a method of preparing a bactericidal and virucidal fabric including dip-coating the formulation according to any one of the embodiments of the present invention to a fabric.

In a first embodiment, the present method further includes drying the fabric at approximately 120 degrees Celsius for approximately 10 minutes after said dip-coating the formulation to the fabric at 25 degrees Celsius for approximately 5 minutes.

According to the first embodiment of the present method, the fabric has an increment in Grams per Square Meter (GSM) value of approximately 13.0 to 20.0 g/m$^2$, and the fabric is a non-woven fabric including polypropylene, polyethylene, or any combination thereof.

In a second embodiment of the present method, the present method further includes preparing a first solution, which includes dissolving a beta-cyclodextrin-containing compound associated with zinc ions and ethylenediaminetetraacetic acid, citric acid, and sodium dihydrogen phosphate in a weight ratio of 11:50:15 into water at approximately 60 degrees Celsius until thoroughly dissolved, followed by immersing the fabric into the first solution at approximately 60 degrees Celsius for about 5 minutes, padding the fabric and drying thereof at approximately 90 degrees Celsius for about 10 to 20 minutes, increasing the drying temperature to approximately 120 degrees Celsius to dry the fabric for another 20 minutes, followed by rinsing the dried fabric with water and padded drying, wherein the fabric is woven fabric including cotton fabric.

According to the second embodiment of the present method, the present method further includes immersing the dried fabric after said padded drying into a second solution including sodium hydrogen carbonate at 50 g/L in water at room temperature for about 15 to 20 minutes, rinsing the fabric with water, and padded drying thereof.

According to the preceding embodiment of the present method, the present method further includes immersing the dried fabric after being immersed into the second solution into a third solution comprising zinc acetate 60 g/L in water at room temperature for about 10 minutes, rinsing the fabric with water, padded drying thereof, followed by drying at 90 degrees Celsius for about 10 to 20 minutes.

The fabric after being immersed into the first, second and third solutions sequentially and subjected to respective drying according to various embodiments of the present method has an increment in Grams per Square Meter (GSM) value of approximately 15.0 g/m$^2$, and the fabric is a woven fabric including cotton fabric.

Alternatively, a solution mixture containing a beta-cyclodextrin-containing compound, a second organic acid, a vinyl polymer and one or more metal salts in a weight ratio of 2:2:2:1 being dissolved in water at approximately 25 degrees Celsius followed by stirring thoroughly at approximately 80 degrees Celsius is prepared for dip-coating the fabric for approximately 5 minutes at 25 degrees Celsius under stirring, followed by drying at approximately 120 degrees Celsius for approximately 10 minutes without padding. A coating GSM value of approximately 13.0 to 20.0 g/m$^2$ is obtained, and the fabric is a non-woven fabric including, but not limited to, polypropylene, polyethylene, or any combination thereof.

The fabric prepared by the present method according to any one of the embodiments described herein has an antibacterial activity value of at least 3.0 and/or antiviral activity value of at least 2.5.

The fabric that is prepared according to the present invention is capable of reducing bacterial growth and activity from bacteria comprising one or more of *Staphylococcus aureus, Klebsiella pneumonia* and *Escherichia coli*, and/or is capable of reducing viral growth and activity from viruses comprising H1N1 and H3N2 strains, and coronavirus of HCoV-229E (Human Coronavirus) and of SARS-CoV-1 (responsible for the pandemic outbreak in Asia in 2003)

Definitions

The terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods of preparation described herein, the steps can be carried out in any order without departing from the principles of the invention, except when a temporal or operational sequence is explicitly recited. Recitation in a claim to the effect that first a step is performed, and then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first, step E is carried out last, and steps B, C, and D can be carried out in any sequence between steps A and E, and that the sequence still falls within the literal scope of the claimed process. A given step or sub-set of steps can also be repeated. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

"Association" or its variations described herein with respect to the interaction between different compounds, molecules and/or substances may refer to any physical, chemical and/or other possible bonding between the compounds, molecules and/or substances where such expression or term is applied.

DETAILED DESCRIPTION

The present invention will be described in detail through the following embodiments/examples. It should be understood that the specific embodiments are provided for an illustrative purpose only, and should not be interpreted in a limiting manner.

EXAMPLES

Example 1

Table 1 below provides the formulation for incorporating bactericide and virucide into non-woven fabric.

TABLE 1

| Formulation on non-woven fabric: | |
|---|---|
| Materials | Amount |
| Sodium (beta-cyclodextrin)propylsulphonate | 25 g |
| Zinc acetate dihydrate | 12.5 g |
| Polyvinyl alcohol | 25 g |
| Citric acid monohydrate | 25 g |
| Distilled water | 1162.5 g |

Preparation Procedure:

1. Polyvinyl alcohol (2% wt against water) was first dissolved in water at 80 degrees Celsius with stirring until it was fully dissolved. The solution was then cooled down to 25 degrees Celsius and citric acid monohydrate (2% wt against water), sodium (beta-cyclodextrin)propylsulphonate (2% wt against water) and zine acetate dihydrate (1% wt against water) were added into the solution at 25 degrees Celsius. The mixture was then stirred at 25 degrees Celsius until all materials were dissolved;
2. Non-woven fabric (e.g., PE or PP) was dipped into the mixture obtained from 1 and completely immersed therein for 5 minutes at 25 degrees Celsius under stirring to make the fabric soaking wet;
3. The wet fabric was dried at 120 degrees Celsius for 10 minutes.

A coating GSM of about 13.0 to 20 g/m$^2$ was resulted in the fabric after drying.

Below summarizes the bactericidal activity (Table 2) and virucidal activity (Table 3) of the non-woven fabric incorporated with the formulation 1 and the procedure described in this example, using the test standards ISO 20743 and ISO 18184, respectively, with methods that are known in the state-of-the-art

TABLE 2

| Bactericidal Activity: | | | |
|---|---|---|---|
| | Test Strain | Contact Time | Bactericidal Activity ($Log_{10}$) |
| Example 1 | *Staphylococcus aureus* | 2 h | >4.79 |
| | *Klebsiella pneumonia* | | >5.71 |

From Table 2, the bactericidal activity of the PP non-woven fabric of the Example 1 is reflected by the bactericidal activity ($Log_{10}$) over a 24-hour test.

TABLE 3

| Virucidal Performance: | | | |
|---|---|---|---|
| | Test Strain | Contact Time | Virucidal Activity ($Log_{10}$ $TCID_{50}$/mL) |
| Example 1 | H1N1 A/PR8/34 | 5 min | 3.73 |
| | | 2 h | 6.56 |
| | H3N2 | 5 min | 3.11 |
| | | 2 h | 4.89 |
| | SARS-CoV-1 | 5 min | 1.25 |

From Table 3, it shows that the PP non-woven fabric incorporated with the formulation 1 is effective in reducing the viral titer of different strains (herein include H1N1 A/PR8/34, H3N2 and SARS-CoV-1) within 2-hour test. When comparing the two viral strains, it seems that the PP non-woven fabric incorporated with formulation 1 is more effective in reducing the titer of H1N1 A/PR8/34 strain than that of H3N2, but it is not conclusive until more viral strains are tested. Overall, the fabric incorporated with the formulation 1 has virucidal activity against certain commonly known viruses, including coronavirus SARS-CoV-1.

Example 2

Table 4 below provides the formulation for incorporating bactericide and virucide into non-woven fabric.

TABLE 4

| Formulation on non-woven fabric: | |
|---|---|
| Materials | Amount |
| Sodium (beta-cyclodextrin)propylsulphonate | 25 g |
| Zinc acetate dihydrate | 12.5 g |
| Copper(II) acetate hydrate | 12.5 g |
| Polyvinyl alcohol | 25 g |
| Citric acid monohydrate | 25 g |
| Distilled water | 1150 g |

Preparation Procedure:

1. Polyvinyl alcohol (2% wt against water) was first dissolved in water at 80 degrees Celsius with stirring until it was fully dissolved. The solution was then cooled down to 25 degrees Celsius and citric acid monohydrate (2% wt against water), sodium (beta-cyclodextrin)propylsulphonate (2% wt against water) and zine acetate dihydrate (1% wt against water) and copper(II) acetate hydrate (1% wt against water) were added into the solution at 25 degrees Celsius. The mixture was then stirred at 25 degrees Celsius until all materials were dissolved;
2. Non-woven fabric (e.g., PE or PP) was dipped into the mixture obtained from 1 and completely immersed therein for 5 minutes at 25 degrees Celsius under stirring to make the fabric soaking wet;
3. The wet fabric was dried at 120 degrees Celsius for 10 minutes.

A coating GSM of about 13.0 to 20 g/m$^2$ was resulted in the fabric after drying.

Below summarizes the virucidal activity (Table 5) of the non-woven fabric incorporated with the formulation and the procedure described in this example against coronaviruses, using the test standards ISO 18184, respectively, with methods that are known in the state-of-the-art

TABLE 5

| Virucidal Performance against Coronaviruses: | | | |
|---|---|---|---|
| | Test Strain | Contact Time | Virucidal Activity ($Log_{10}$ $TCID_{50}$/mL) |
| Example 2 | HCoV-229E | 5 min | 2.50 |
| | SARS-CoV-1 | 5 min | 2.73 |

From Table 5, it shows that the PP non-woven fabric incorporated with the formulation is effective in reducing the viral titer of different strains of coronaviruses HCoV-229E (Human Coronavirus) and of SARS-CoV-1 (responsible for the pandemic outbreak in Asia in 2003) within contact time of 5 minutes.

Example 3

Below illustrates the formulation and procedure in two parts for incorporating bactericide into a cotton woven fabric

TABLE 6

| Formulation for Cotton Fabric - Part I: | |
|---|---|
| Materials | Amount |
| Beta-cyclodextrin-containing compound associated with zinc ions and ethylenediaminetetraacetic acid described in the third embodiment | 22 g |
| Citric acid | 100 g |
| Sodium dihydrogen phosphate | 30 g |
| Distilled water | 1 L |

Procedure I:

1. All of the solid reagents were dissolved in water at 60 degrees Celsius to obtain a first solution;
2. A piece of cotton fabric was dipped into the first solution for 5 minutes at 60 degrees Celsius;
3. The fabric was padded, and dried in an oven at 90 degrees Celsius for 10-20 minutes, then at 120 degrees Celsius for 20 minutes;
4. The dried fabric was rinsed with water, padded dry again.

TABLE 7

| Formulation for Cotton Fabric - Part II: | |
|---|---|
| Materials | Amount |
| Sodium hydrogen carbonate | 50 g |
| Zinc acetate | 60 g |
| Distilled water | 1 L |

Procedure II

1. Sodium hydrogen carbonate was dissolved in 1 liter distilled water at room temperature to obtain a second solution;
2. Cotton fabric from Part I was immersed into the second solution for 15 to 20 minutes;
3. The wet fabric was rinsed with distilled water, padded dry;
4. Zinc acetate was dissolved in 1 liter distilled water in another container at room temperature to obtain a third solution;
5. Cotton fabric from step 3 was immersed into the third solution for 10 minutes;
6. The fabric was rinsed with water, padded dry again, and dried in oven at 90 degrees Celsius for 10-20 minutes;

A coating GSM of approximately 15 g/m$^2$ was resulted from the cotton fabric incorporated with the formulation in Example 2.

Below (Table 6) illustrates the durability of the bactericidal performance of cotton fabric incorporated with the formulation described in Example 2 in terms of the difference in bacterial count reduction before and after 30 cycles of laundry washing and tumble dry, tested using the methods described in AATCC 100.

TABLE 8

| Bactericidal Performance: | | | |
|---|---|---|---|
| Test Strain | Contact Time | Effective Bacterial Count Reduction ($Log_{10}$) | Effective Bacterial Count Reduction After 30 Home Laundry Washing and Tumble Dry Cycles ($Log_{10}$) |
| *Staphylococcus aureus* | 24 h | 3.0 | 3.0 |
| *Klebsiella pneumonia* | | 3.2 | 3.2 |
| *Escherichia coli* | | 3.3 | 3.3 |

From Table 8, it shows that the effective bacterial count reduction in three different bacterial strains after 30 cycles of home laundry washing and tumble dry remains unchanged. It can be concluded that the bactericidal activity of the woven fabric prepared according to the formulation and procedures in this example is durable even it is subjected to repeated washing and tumble dry, mimicking the situation of daily use of the products made of this kind of fabric.

INDUSTRIAL APPLICABILITY

The present invention is applicable in textile and disposable wearables including but not limited to specialized wearables and gears, medical device and equipment, which require antibacterial and/or antiviral functions.

The invention claimed is:

1. A dip-coating, antibacterial and antiviral formulation for preparing a bactericidal and virucidal fabric, the formulation comprising:

at least a beta-cyclodextrin-containing compound associated with zinc ions, and water to exert bactericidal and virucidal effect of the fabric on bacteria and/or viruses;

at least one organic acid; and at least one metal salt, wherein the beta-cyclodextrin comprises at least one carboxylic ester unit and one carboxylic acid unit.

2. The formulation of claim 1, wherein a first organic acid of the at least one organic acids is ethylenediaminetetraacetic acid and is in a mole ratio of 4:1 to the beta-cyclodextrin.

3. The formulation of claim 2, wherein a second organic acid of the at least one organic acid is citric acid.

4. The formulation of claim 3, wherein the at least one metal salt comprises sodium dihydrogen phosphate, sodium hydrogen carbonate, zinc acetate and copper (II) acetate.

5. The formulation of claim 1, further comprising a vinyl polymer.

6. The formulation of claim 1, wherein the at least one organic acid is citric acid.

7. The formulation of claim 1, wherein the at least one metal salt is at least one of copper (II) acetate, zinc acetate, or sodium dihydrogen phosphate.

8. A method of preparing a bactericidal and virucidal fabric comprising:

immersing a fabric into a solution comprising the dip-coating, antibacterial and antiviral formulation of claim 1;

padding and drying the fabric to create a bactericidal and virucidal dip-coated fabric capable of reducing bacterial growth and activity from bacteria comprising one or more of *Staphylococcus aureus, Klebsiella pneumonia* and *Escherichia coli*, and/or is capable of reducing viral growth and activity from viruses comprising H1N1 and H3N2 strains, and coronavirus.

* * * * *